United States Patent [19]

Duyckinck

[11] Patent Number: 4,523,990

[45] Date of Patent: Jun. 18, 1985

[54] PARTICULATE CLASSIFYING APPARATUS

[75] Inventor: Robert W. Duyckinck, New Providence, N.J.

[73] Assignee: Mikropul Corporation, Summit, N.J.

[21] Appl. No.: 589,129

[22] Filed: Mar. 13, 1984

[51] Int. Cl.[3] ..... B04B 5/12

[52] U.S. Cl. ..... 209/138; 209/145; 209/3

[58] Field of Search ..... 209/144, 138, 139 A, 209/139 R, 145, 3; 241/53

[56] References Cited

U.S. PATENT DOCUMENTS

| | | | |
|---|---|---|---|
| 3,234,716 | 2/1966 | Sevin et al. | 209/144 |
| 3,285,523 | 11/1966 | Duyckinck et al. | 241/53 |
| 3,308,949 | 3/1967 | Schaver | 209/139.2 |
| 3,333,777 | 8/1967 | Highfill, Jr. et al. | 241/47 |
| 3,670,886 | 6/1972 | Hosokawa et al. | 209/144 X |
| 4,260,478 | 4/1981 | Hosokawa et al. | 209/144 X |

OTHER PUBLICATIONS

"*1 ACM Mikro-Pulverizer*", Brochure by Pulverizing Machinery Division of Mikropul Corp., Oct. 1982, 10 Chatham Rd., Summit, NJ 07901.

*Primary Examiner*—Frank W. Lutter
*Assistant Examiner*—Thomas M. Lithgow
*Attorney, Agent, or Firm*—Nims Howes Collison & Isner

[57] ABSTRACT

Apparatus for classifying carrier gas borne particulates including a chamber having a classifying rotor suspended therewithin fed by a jet pump induced transport path of carrier gas in the periphery of said chamber.

8 Claims, 2 Drawing Figures

PARTICULATE CLASSIFYING APPARATUS

This invention relates to the separation of particulates and more particularly to an improved construction for radial flow classifier apparatus for separating a selective size range of carrier borne particulates from the totality thereof.

Effecting a reduction in size or comminution of solid materials of diverse character has long been a significant required operation in the practical manufacture of many and diverse commercial products. The separation of particulate materials from a carrier gas stream (usually air) and the classification of comminuted particulate materials into fractions of known size range is generally of appreciable, if not equal, significance in the economic fabrication of such products. To the above end, comminuting apparatus of many types such as crushers, grinders, hammer mills, etc. have long been available in the art, as have many types of apparatus for separating comminuted particulate materials from a carrier gas stream. One broad class of such separator apparatus in common usage is the so-called radial flow separator wherein a plurality of vanes are rotated in a path generally normal to that of the particulate bearing gas stream. In addition, multivane radial flow separators that additionally perform a classification function are also generally old in the art and one such unit is shown in my U.S. Pat. No. 3,285,523 wherein a multivane radial flow separator was enclosed within a selectively shaped grinding chamber to effect the selective removal of a predetermined size range of particulates therefrom.

This invention may be briefly described, in its broad aspects, as an improved construction for radial flow separator-classifier devices having a multivane classifying rotor suspended within a selectively contoured cylindrical chamber and dependently terminating in an elongate tapering tailings chute together with an annular isolating baffle spaced from the chamber wall and disposed intermediate such wall and the classifying rotor in association with an intermediate selectively shaped fluidizing bed nozzle assembly disposed in the upper portion of the tailings chute that contributes to the definition of an improved gas transport system for suspended particulates compositely constituted of a main and an auxiliary carrier gas stream.

Among the advantages of the subject invention is the provision of an efficient and economically operable radial flow classifier device that provides for continuously operable separation of selective size ranges of particulates at reduced cost. Another advantage of the subject invention is the provision of an efficient radial flow classifier construction of extended operating life and further characterized by a sharply defined line of demarcation between rejected tailings and the separated acceptable product. Another advantage of the subject invention is its ability to deaglomerate; i.e. its ability to dislodge fines from tailings by blowing them off with high energy carrier gas as they pass the peripheral gas slits. These fines would otherwise cling to the tailings, and be discarded therewith, rather than passing through the rotor as desired and being separated out.

The primary object of this invention is the provision of an improved construction for radial flow classifiers.

Another further object of this invention is the provision of an improved gas transport system for radial flow classifiers.

Other objects and advantages of the subject invention will become apparent from the following specifications and from the appended drawings which in accord with the mandate of the patent statutes schematically illustrate the essentials of a presently preferred classifier construction incorporating the principles of this invention.

Referring to the drawings.

Figure 1:
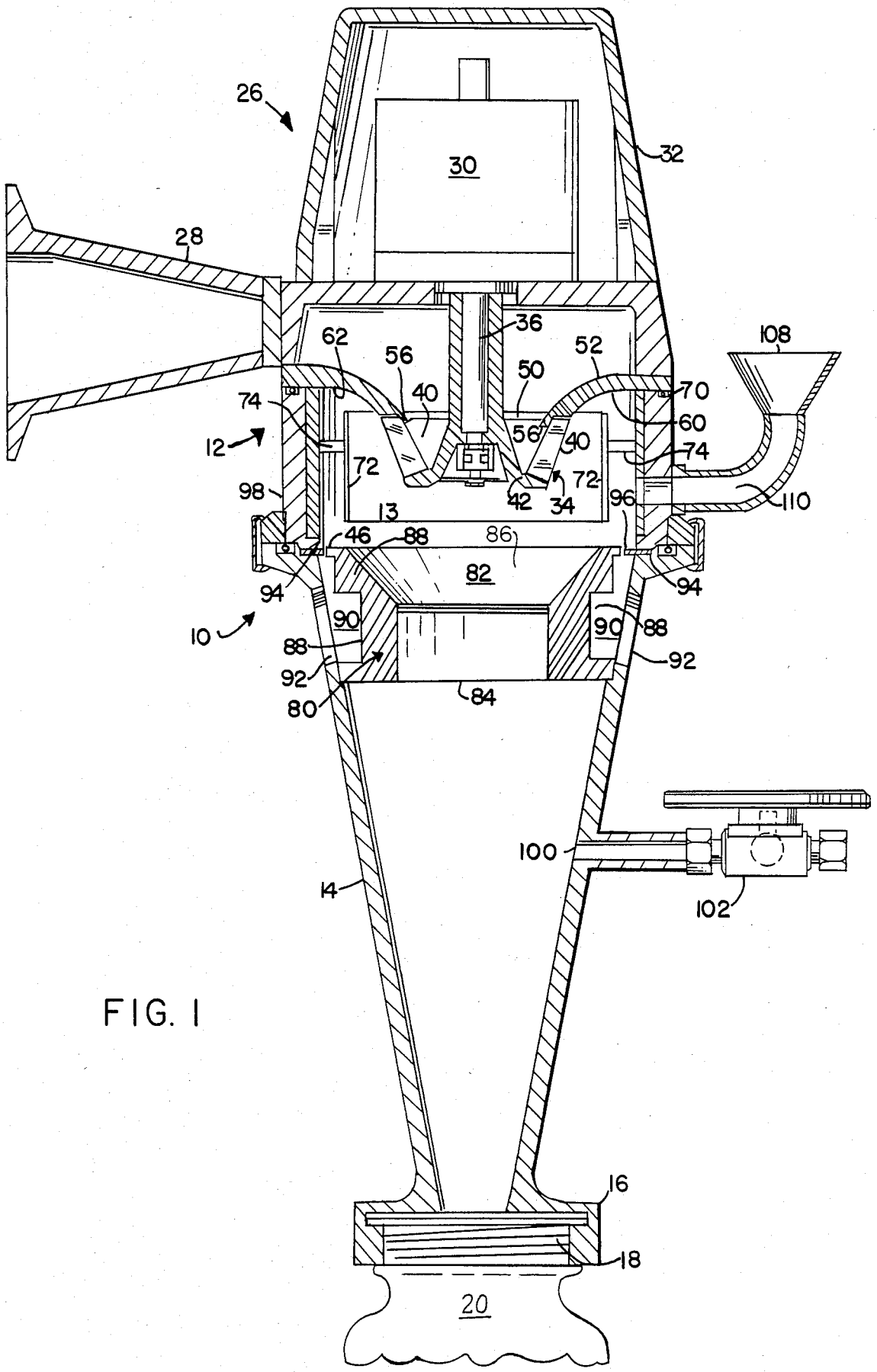
FIG. 1 is a vertical section through a radial flow classifier device that incorporates the principles of this invention.

Referring initially to FIG. 1, there is provided an elongate housing, generally designated 10, having an intermediate cylindrical portion of limited vertical extent, generally designated 12, defining a classification chamber 13. Dependent from the bottom of the cylindrical intermediate portion 12 of the housing is an elongate, downwardly tapering and generally conically shaped tailings delivery chute 14. The dependent end 16 of the tails delivery chute 14 is selectively configured as at 18 for connection of a particulate tail recovery means thereto, such as a removable container 20 or the like.

Mounted above the cylindrical classification chamber 13 is an outlet manifold assembly 28, a drive motor 30 disposed within a housing cap 32, a selectively contoured roof cap 52 for the classifying chamber whose annular dependent end defines an axially located bore 50, and a peripherally vaned classifying rotor 34 mounted on the dependent end of the motor 30 drive shaft 36. The vaned classifying rotor 34 is adapted to be driven at a preselected and predetermined speed in accordance with desired particle size range to be delivered through the outlet manifold 28.

Figure 2:
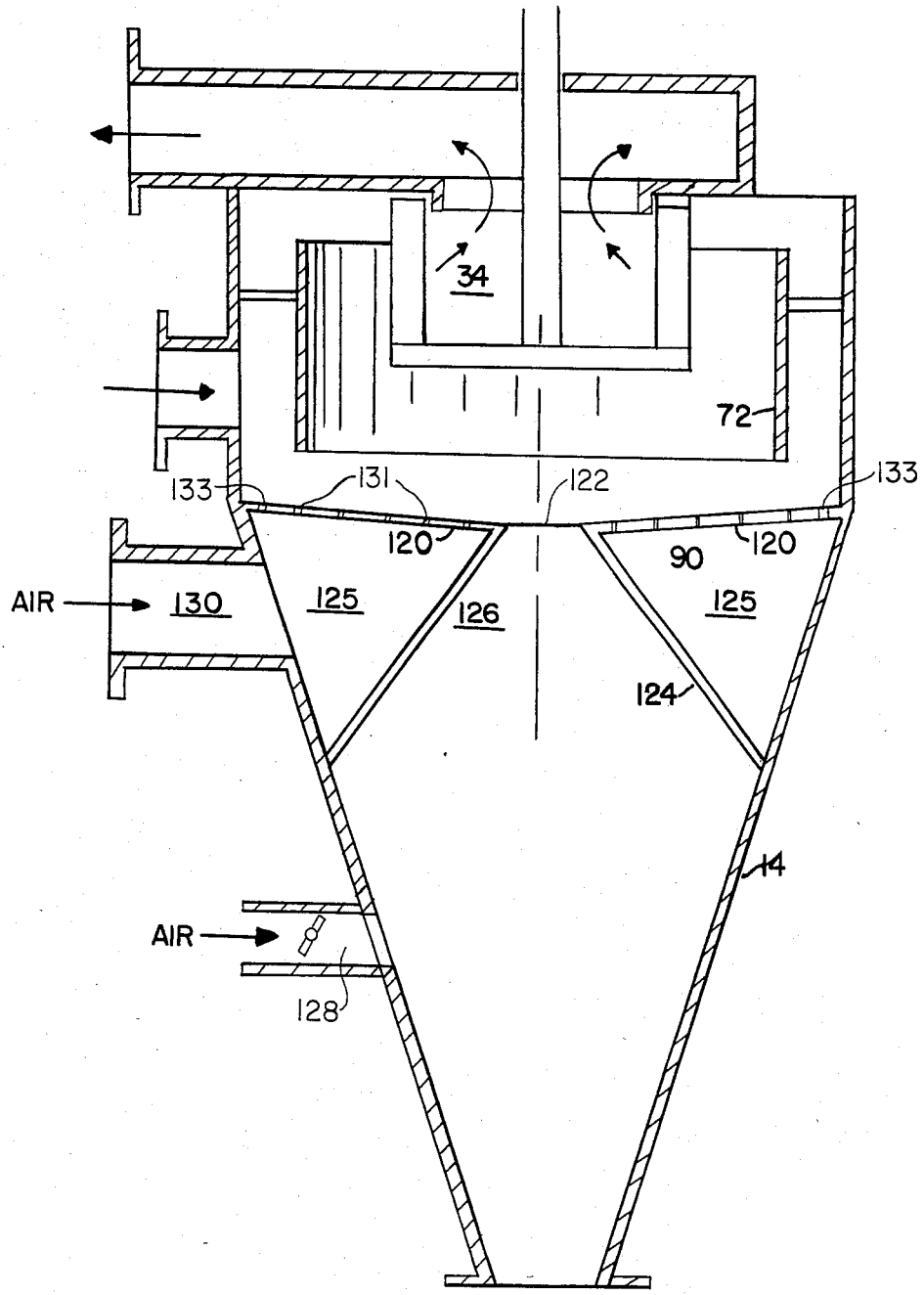
FIG. 2 is a vertical section through an alternative construction for a radial flow classifier that incorporates the principles of this invention.

The classifying rotor 34 disposed within the classifying chamber 13 is preferably of a truncated conical configuration having a plurality of annularly disposed and spaced vane members 40 mounted on a rotatable base plate 42. Advisedly, this conical configuration will generally be used where rotational g levels at the hammer tips do not exceed those that would be generated by a hammer assembly having 6 inch internal diameter and rotating at 5000 r.p.m. For higher g levels a rectangular or cylindrical rotor configuration 34 as shown in FIG. 2 might be desirable.

The upper ends of the vane members 40 are disposed in close parallel proximity with the dependent defining edge of the bore 50 in the roof cap 52. More specifically, the dependent end portion of the roof cap 52 which forms the bore 50 is provided with an annular dependent flane 56 disposed to the rear or upstream side of the upper ends of the vanes 40. Such annular flange 56 serves to block a possible straight line bypass passage or channel for particulate matter that is necessarily formed by the required clearance space between the upper ends of the rotating vanes 40 and the adjacent bore defining marginal edge of the roof cap 52.

As is apparent from the drawings, the envelope represented by the annular disposition of the tips of the vane members 40 is complementally continued by the selective contouring of the adjacent downwardly curved surface 60 of the dependent end portion of the roof cap 52 so as to effectively form an unbroken envelope of essentially truncated conical configuration. The upper portion of curved surface 60 of the roof cap 52 merges into an essentially horizontal planar peripheral portion 62 thereof which is sized to be disposed in interfacial relation with the top of the vertical side wall portion of the intermediate housing section 12.

Preferably, the entire outlet manifold assembly including roof cap 52, the vaned classifying rotor 34, the motor 30, the outlet manifold 28 and the motor housing 32 are desirably constructed so as to be removably securable as a unit as by pivotal mounting to the intermediate housing section 12. Airtight interconnection therebetween is effected by means of a suitable peripheral seal such as O-ring 70.

Disposed within the classifying chamber 13 defined by the intermediate cylindrical housing portion 12 is an annular isolating baffle member 72. The baffle 72 is spaced inwardly from the side wall portion of the housing 12 by suitable pin members 74, and is of a vertical extent sufficient to extend upwardly slightly beyond the upper ends of the vanes 40 and downwardly to a location well below the bottom of the rotor base 42.

Mounted at the upper end of the tapering tails delivery chute 14 is a selectively shaped nozzle member, generally designated 80. As shown in FIG. 1, such nozzle member 80 is selectively shaped to provide an upwardly and outwardly flaring axial bore 82 of a generally funnel-like configuration. The bore 82 dependently terminates in a circular aperture 84 of reduced transverse dimension as compared to the upper and outwardly invertedly conical mouth thereof 86. Upward air flow through bore 82 serves as an airlock to prevent the downward flow of air with the fines said downwardly moving air carries. The recessed outer wall portion thereof 88 is shaped in association with the wall of the chute 14 to provide an annular peripheral air intake manifold 90 fluidly connected to a plurality of peripheral air inlet apertures 92 in the chute wall. The circular upper perimetric marginal edge of the wall 88, in association with an inwardly projecting ring member 94, defines an annular peripheral air entry channel or jet pump 96 into the bottom of the classifying chamber 13 disposed in inwardly spaced relation from the perimetric defining wall 98 of the classifying chamber 13. Such channel 96 serves as the exit vent for the air intake manifold 90 and functions to provide an upwardly moving curtain of air disposed intermediate the wall 98 of the chamber 13 and the annular isolating baffle member 72 and serves as a jet pump means to induce a transport path around the baffle 72, circulating gas and particles down inside the baffle 72 and up outside the baffle 72.

Disposed beneath the nozzle member 80 and located well down in the tapering tailings chute 14 is an auxiliary air inlet 100 connected to a suitable ball valve 102 or the like for regulating the quantity of air introducable into the tailings chute therethrough. Solids input of particulate material into the classifier chamber 13 is effected through hopper 108 and tangential to the circumference of said chamber 13 through solids feed channel 110 which may, if desired, contain an auger type feed screw member or the like.

In operation of the described unit, rotation of the classifying rotor 34 in association with operation of an exhaust fan (not shown) or other carrier gas prime movant disposed downstream of the exhaust manifold 28 functions to effect an induced primary flow of air inwardly through the intake apertures 92 in the tailings chute 14 into the annular manifold 90 and an upwardly selectively directed and located flow thereof at markedly increased velocities typically about 4000 cubic feet per minute, through the peripheral slot 96, in the form of an upwardly directed moving stream of primary air in the general form of an annular curtain which passes exteriorly of the annular baffle 72. Said moving stream of primary air is converted into a composite and generally helical flow path by the induced air swirling action of the rotating classifying rotor 34. The direction of such flow upwardly and helically moving curtain of primary air is turned by the roof cap 60 into generally downwardly directed flow along curved surface 60 in a path disposed closely adjacent to the periphery of the moving vanes 40 of the classifying rotor 34.

The upwardly and helically moving primary air stream as described above serves to entrain and lift all but perhaps the largest sized particulates peripherally introduced into the classifying chamber 12 through the solids intake channel 110. As will now be apparent, the above described swirling primary air stream carrier, due to the upward and rotative velocity components involved, will be selectively displaced, with the entrained particulates in a path adjacent the side wall of the intermediate classifying chamber 13 and will gradually rise and descend in a circular path under influence of the applied pressure differential until it encounters the classifying rotor 34.

As is conventional in radial flow classifiers, the speed of rotation of the vaned classifier rotor 34 is adjusted to permit comminuted material of a dimension below a predetermined size to pass with the moving carrier gas stream through the rotating vanes 40 and into the outlet manifold 28 under induction of a downstream prime movant and, at the same time, to selectively reject, by both centrifugal action and impact, the heavier or coarser particulate material for either recycling within the classifying chamber or for disposition through the aperture 84 into the tailings chute 14. A portion of the carrier air stream will not pass through the rotor 34 and will be directed, in a downwardly and outwardly moving path toward the perimetric chamber wall.

As will now be apparent, the carrier entrained comminuted material as introduced through the intake 110, will approach the classifier blades 40 on a substantially smooth and confined course with a reduced vertical velocity component and preferably in a path tangential to the circumference of the chamber wall 98 in order to achieve maximum dispersion around the baffle 72.

The oversized particles that are rejected by the classifying means either through impact or through centrifugal or inertial effects will be generally downwardly displaced in conjunction with the carrier air into the upper portion of the bell-shaped bore 82 of the airlock nozzle member 80. Concurrently therewith, auxiliary air introduced into the tailings chute 14 through air intake channel 100 will move upwardly and at a markedly increased velocity through restricted aperture 84. As such auxiliary air stream exits from the aperture 84, it will be directed outwardly and upwardly in a generally helical path, with a progressively decreasing vertical velocity component by the conjoint action of the surface contour of the outwardly flaring shape 82 of the nozzle member 80 and by the continued swirling action of the downwardly and outwardly moving main carrier gas stream as it moves downwardly past the classifying rotor 34 in a path to remerge with the primary air curtain emanating from the peripheral slot 96. Depending upon the velocity of the air stream moving upwardly through the reduced sized aperture 84, generally about 10 cubic feet per hour, and the subsequent helical displacement thereof, as described above, such upwardly moving stream will serve to suspend and sweep upward, the fine particulates that have been rejected by the rotor 34 in the generalized form of an airlock. However, such airlock characteristics, as a function of air velocity through aperture 84, may be controlled so as to permit a predetermined fraction of the heavier rejected particles to continue their downward movement through the bore 82 and aperture 84 for ultimate collection in the container 20. The lighter particulates, however, will be re-trained in the upwardly and outwardly moving air stream toward the periphery of the classifying chamber 13 where they will again be re-entrained by the jet pump and joined with the induced upwardly moving air curtain flowing through the peripheral aperture 96 for representation to the classifying rotor 34. Most importantly, the airlock prevents air which contains suspended fines from passing out the tailings chute 14.

FIG. 2 is schematically illustrative of an alternative construction for a nozzle member adapted to be disposed at the upper end of the tailings chute 14 and which again serves the dual function of providing both main and auxiliary air intake paths for the carrier air into and through the classifying chamber 13. In this embodiment the upper portion of the nozzle member is in the form of an annular disc 120 canted or downwardly sloped toward the center to provide a dependent axial opening 122 of markedly restricted cross-sectional extant.

Disposed beneath the opening 122 is a conically shaped wall 124 which functions to provide a converging nozzle 126 for increasing the speed of the auxiliary air stream introduced through auxiliary air intake 128 as it approaches aperture 126 as well as to provide one wall of the primary air intake manifold 125. The air intake manifold 125 is further perimetrically defined by the outer wall of tailings chute 14 and by plate 120 and is supplied with air through air intake 130. In contradistinction to the FIG. 1 embodiment, manifold 125 is vented into the classifying chamber 13 through a plurality of selectively located and sized apertures 131 in the the upper plate section 120 thereof. Here again, however, the combined effect of the primary air stream exiting from the manifold 125 is to form, in association with the auxiliary air stream flowing through aperture 122, an upwardly and generally helically moving carrier air stream in the nature of a fluidized bed to support and reintroduce the particulates rejected by the classifying rotor 34 into the main air transport path exteriorly of the annular baffle 72 for representation to the classifying rotor 34.

In this embodiment, the desired character of the fluidized bed is in part determined by the size and location of the apertures 131 in the upper plate section 120. Specifically, a sufficient concentration of appropriately sized apertures 133 may be suitably located and concentrated in the area adjacent the outer periphery of the plate section 120 to effectively provide the desired upwardly moving air curtain adjacent the wall of the classifying cylinder 12 and behind the baffle 72. In a similar manner, the size and location of the vents 131 over the portions of the surface of plate 120 nearer the center thereof may be appropriately spaced and sized to povide, in association with the auxiliary air stream, for an effective suspension of the rejected particulates in the composite air stream that results therefrom. Here again, the rejected particulates which are too large to permit re-entrainment within the chamber 13 will move down the inclined plate 120 toward the aperture 122 for ultimate displacement therethrough, dependent upon the air velocity of the upwardly moving auxiliary air stream through said aperture 122, into the tailings chute 14.

Having thus described my invention, I claim:

1. Apparatus for classifying particulate material entrained in a gaseous carrier comprising a generally cylindrical chamber having a carrier gas outlet at the upper end thereof, and a perimetric cylinder wall, means for introducing particulate material into said chamber, a radial flow classifying rotor associated with said carrier gas outlet to selectively reject oversize particulate material from the carrier gas stream passing therethrough, a tailings delivery chute dependent from the lower end of said chamber, a nozzle assembly disposed in the upper end of said tailings chute for creating a jet pump induced transport path of carrier gas in the periphery of said chamber and having a restricted axial aperture therein for passage of tailings from said chamber to said chute, said nozzle member further including first means for selectively directing an upwardly moving curtain of carrier gas adjacent to the perimetric cylinder wall of said cylindrical chamber, said curtain serving as a jet pump inducing a transport path and serving as a deaglomerating mechanism, gas inlet means feeding said carrier gas into the nozzle, and annular isolating baffle means disposed intermediate said cylinder wall and said classifying rotor to define an annular channel for said upwardly moving curtain of air.

2. Apparatus as set forth in claim 1 wherein said nozzle assembly is in the form of an outwardly and upwardly flaring nozzle having the upper perimetric defining edge disposed in closely spaced relation with the wall of said cylindrical chamber to define an annular carrier gas entry slot therebetween.

3. Apparatus as set forth in claim 1 wherein said nozzle assembly is in the form of a downwardly canted annular disc terminating in said restricted axial aperture and wherein said disc includes a plurality of selectively sized and spaced perforations therein to compositely form said upwardly moving curtains of carrier gas adjacent to the perimetric cylinder wall of said cylindrical chamber.

4. Apparatus as set forth in claim 1 further including second means for selectively directing an upwardly directed auxiliary drift of carrier gas through said axial aperture countercurrent to the direction of tailings passage therethrough.

5. Apparatus as set forth in claim 1 wherein the upper end of said cylindrical chamber is of a generally annular configuration formed in part by said radial flow classifying rotor and in part by an inner surface curved to provide a substantially smooth carrier gas approach path to said rotor.

6. Apparatus for classifying particulate material entrained in a gaseous carrier comprising, a generally cylindrical chamber having a carrier gas outlet at the upper end thereof and a perimetric cylinder wall, a radial flow classifying rotor associated with said carrier gas outlet to selectively reject oversize particulate material from the carrier gas stream passing therethrough;

a tailings delivery chute dependent from the lower end of said chamber, an annualr isolating baffle member disposed intermediate the perimetric defining wall of said cylindrical chamber and said classifying rotor and intermediate the upper and lower ends of said chamber, means for introducing particulate material into said chamber intermediate the perimetric wall thereof and said baffle member, a fluidizing nozzle assembly disposed in the upper end of said tailings chute for creating a jet pump induced transport path of carrier gas in the periphery of said chamber and having a restricted axial aperture therein for passage of tailings from said chamber to said chute, said fluidizing nozzle assembly further including first means for selectively directing an upwardly moving curtain of carrier gas adjacent to the perimetric wall of said cylinder and annular isolating baffle means disposed intermediate said perimetric cylinder wall and said classifying rotor to define an annular channel for said upwardly moving curtain of air.

7. Apparatus as set forth in claim 6 wherein said nozzle assembly is an upwardly and outwardly flaring nozzle member having said restricted axial aperture at the dependent end thereof and its upper perimetric defining edge disposed in closely spaced relation with the wall of said cylindrical chamber to define an annular carrier gas entry slit therebetween and defining said first means for selectively directing said upwardly moving curtain of carrier gas intermediate said baffle member and the perimetric wall of said chamber.

8. Apparatus as set forth in claim 6 further including second means for selectively directing an upwardly directed auxiliary stream of carrier gas through said axial aperture counter-current to the direction of tailings passage therethrough.

* * * * *